US005391039A

United States Patent [19]

Holtom

[11] Patent Number: 5,391,039

[45] Date of Patent: Feb. 21, 1995

[54] REFUSE LOADER ARM

[75] Inventor: Stephen W. Holtom, Greystanes, Australia

[73] Assignee: Matrik Pty. Ltd., Australia

[21] Appl. No.: 124,858

[22] PCT Filed: Jul. 24, 1991

[86] PCT No.: PCT/AU91/00331

§ 371 Date: May 26, 1992

§ 102(e) Date: May 26, 1992

[87] PCT Pub. No.: WO92/01612

PCT Pub. Date: Feb. 6, 1992

Related U.S. Application Data

[63] Continuation of Ser. No. 842,161, May 26, 1992, abandoned.

[30] Foreign Application Priority Data

Jul. 24, 1990 [AU] Australia ..... PK 1362

[51] Int. Cl.[6] ..... B65F 3/06

[52] U.S. Cl. ..... 414/408; 414/421; 414/917; 414/733; 414/406; 414/486; 414/555; 414/739

[58] Field of Search ..... 414/408, 409, 407, 406, 414/419, 420, 421, 732, 738, 739, 740, 741, 917, 555, 558, 486, 742, 743; 220/908, 1.5

[56] References Cited

U.S. PATENT DOCUMENTS

| | | | |
|---|---|---|---|
| 3,165,348 | 1/1965 | Keskitalo . | |
| 3,172,693 | 3/1965 | Hansen . | |
| 3,557,967 | 1/1971 | Madole | 414/555 X |
| 4,091,944 | 5/1978 | Gollnick | 414/408 X |
| 4,227,849 | 10/1980 | Worthington | 414/408 |
| 4,227,850 | 10/1980 | Farmer et al. . | |
| 4,329,111 | 5/1982 | Schmid | 414/733 |
| 4,401,407 | 8/1983 | Breckenridge | 414/408 |
| 4,461,608 | 7/1984 | Boda . | |
| 4,543,028 | 9/1985 | Bell et al. . | |
| 4,669,940 | 6/1987 | Englehardt et al. . | |
| 4,708,570 | 11/1987 | Smith et al. . | |

FOREIGN PATENT DOCUMENTS

| | | | |
|---|---|---|---|
| 5444265 | 7/1966 | Australia . | |
| 35636/78 | 5/1978 | Australia . | |
| 75458/81 | 5/1981 | Australia . | |
| 1247083 | 9/1984 | Australia . | |
| 6023190 | 2/1991 | Australia . | |
| 1183859 | 12/1964 | Germany . | |
| 1201756 | 9/1965 | Germany . | |
| 3620610 | 2/1987 | Germany . | |
| 2003115 | 3/1979 | United Kingdom | 414/555 |

*Primary Examiner*—Frank E. Werner
*Attorney, Agent, or Firm*—Larson and Taylor

[57] ABSTRACT

The bin grabbing nipper (22) of a refuse loader arm is held at a constant angle to limb (15) by a parallelogram linkage having pivots (26, 17, 19, 25). Thus, pivoting of limb (15) leads directly to inversion of the raised bin and no separate operation of a special bin tilting ram is required to bring a bin to dumping position. The nipper consists of two opposed, jointed fingers which are separately pivoted to a wrist member (21). All finger joints and wrist joints of the nipper are pivoted by separate hydraulic cylinders supplied by a common source. By sensing back-pressure in each cylinder they can be made to exert equal force. Pivoting at limb joints (17) and (19) is by opposed hydraulic cylinders acting on a rack meshing with a gear wheel. Both these joints may be controlled by a single joystick.

16 Claims, 10 Drawing Sheets

REFUSE LOADER ARM

This application is a continuation of application Ser. No. 07/842,161, filed May 26, 1992, now abandoned (as the National Phase of International Application PCT/AU91/00331).

FIELD OF INVENTION

The present invention relates to a refuse loader arm assembly.

More particularly, the invention relates to an arm assembly for loading refuse contained in a bin into a larger refuse storage chamber. Preferably, the refuse loader arm assembly is mounted on a refuse collection vehicle which also supports the refuse storage chamber.

BACKGROUND ART

It is known to construct refuse loader arm assemblies of a type based on the pivotally extendable and retractable arm principle. The arm assembly may include two or more pivotally connected limb members and terminate in a grab device adapted to grab a bin containing the refuse. The limb members may be actuated so as to cause the arm assembly to pivotally extend towards the bin so that the grab device may be in a position to grab the bin. Once grabbed, the bin may be lifted to a predumping position over the refuse storage chamber by reverse actuation of the limb members.

However, these prior art arm assemblies apparatus generally require a separate actuation of the grab device to cause the bin to tilt from its predumping position and release its contents into the storage chamber. The tilting of the bin has normally been achieved by the actuation of an hydraulic cylinder operable between the outermost limb of the arm assembly and the grab device. The grab device tilt cylinder works in concert with other cylinders operably mounted on the limb members.

The complexity of cylinders and the reliance placed upon their operation in effecting extension and retraction of the loader arm assembly and tilting of the grab device has meant that such prior apparatus are difficult to maintain, heavy and prone to failure.

Furthermore, prior art means of grabbing the bin generally do not include means for controlling the tightness of the grab and are unable to grab and lift differently sized bins or bins that are not in an appropriate alignment with the vehicle. This is because the frames of the grab devices of the prior art are generally fixed, or, if not fixed, have no back pressure responsive correction facility.

It is an object of the present invention to overcome or substantially ameliorate the disadvantages of the prior art.

DISCLOSURE OF THE INVENTION

According to the invention, there is provided a refuse loader arm assembly for raising a refuse bin to a dump position, said arm assembly comprising a first limb pivotally connected to a reference frame at a first pivot point and pivotally connected to a second arm assembly, the said second arm assembly including a grab limb adapted to grab the bin, and including a linkage means to the first limb, whereby the said grab limb is maintained at a fixed angular orientation with respect to said first limb independent of the angular orientation of the balance of said second arm assembly with respect to said first limb throughout the bin raising operation.

Preferably, the linkage means is a linkage limb pivotally connected at one end to the first limb and at the other end to an extended portion of the said grab limb.

Preferably, said second arm assembly comprises a second limb pivotally connected to the first limb at a second pivot point, the grab limb pivotally connected to the second limb at a third pivot point and to the linkage limb at a fourth pivot point located on the said extended portion, and the linkage limb is pivotally connected to the first limb at a fifth pivot point, whereby said second, third, fourth and fifth pivot points interconnect said first, second, grab and linkage limbs into a parallelogram structure.

Preferably, said grab limb includes symmetrically opposed first and second grab fingers.

Preferably, each of said first and second grab fingers comprises first and second limbs articulated about a common pivot point.

Preferably, both said first and second symmetrically opposed grab fingers are pivotally connected to a common portion of said grab limb about separate pivot points.

In a particularly preferred form, each pivot point of said first and second grab fingers has its pivoting angle controlled by a hydraulic cylinder.

Preferably, all of the hydraulic cylinders are fed from a common hydraulic fluid supply whereby equal fluid supply pressure is experienced by each of said cylinders whereby the force exerted by each said cylinder substantially is equal.

Preferably, said reference frame to which said first limb is pivotally connected is a refuse collection vehicle.

Preferably, a first hydraulic ram controls the pivoting angle between said reference frame and said first limb about said first pivot point.

Preferably, a second hydraulic ram controls the pivoting angle between said first limb and said second limb about said second pivot point.

Preferably, said refuse loader arm assembly is utilized to raise a refuse bin to a dump position over a refuse collection vehicle as follows:

(a) with said arm assembly in extended position, said grab fingers are caused to grab the periphery of said bin by supplying hydraulic fluid to said grab cylinders whereby the pivot angle subtended between articulated components comprising said grab fingers is caused to decrease at mutually equal force until said bin is securely grabbed by said grab fingers, (b) said first limb is caused to rotate upwardly about said first pivot point with respect to said reference frame by the action of said first hydraulic ram until said bin is clear of the ground to a predetermined extent, (c) said second limb is caused to close against said first limb about said second pivot point by the action of said second hydraulic ram whereby said grab limb is maintained at a fixed angular orientation with respect to said first limb by the co-operation of interconnected limbs comprising the said second arm assembly, until (d) said first limb reaches an approximately vertical or over vertical dump position whereby said grab limb grabbing said bin has also assumed a dump position and the contents of said bin are released into said refuse collection vehicle.

Preferably, the operation of said first hydraulic ram and of said second hydraulic ram are controlled by a joy stick controller whereby movement of the joy stick through a first line of movement controls the said first hydraulic ram only and movement of said joy stick through a second and different line of movement controls the second hydraulic ram only and movement of said joy stick through an intermediate line causes concurrent actuation of the first and second hydraulic rams.

Preferably, said first line of movement is perpendicular to said second line of movement and so concurrent actuation of both hydraulic rams may be initiated by moving the joy stick in a diagonal line from the start of the first line to the end of the second line.

BRIEF DESCRIPTION OF THE DRAWINGS

In order that the present invention may be more readily understood and put into practical effect, reference will now be made to the accompanying drawings, in which.

DESCRIPTION OF PREFERRED EMBODIMENT

Figure 1:
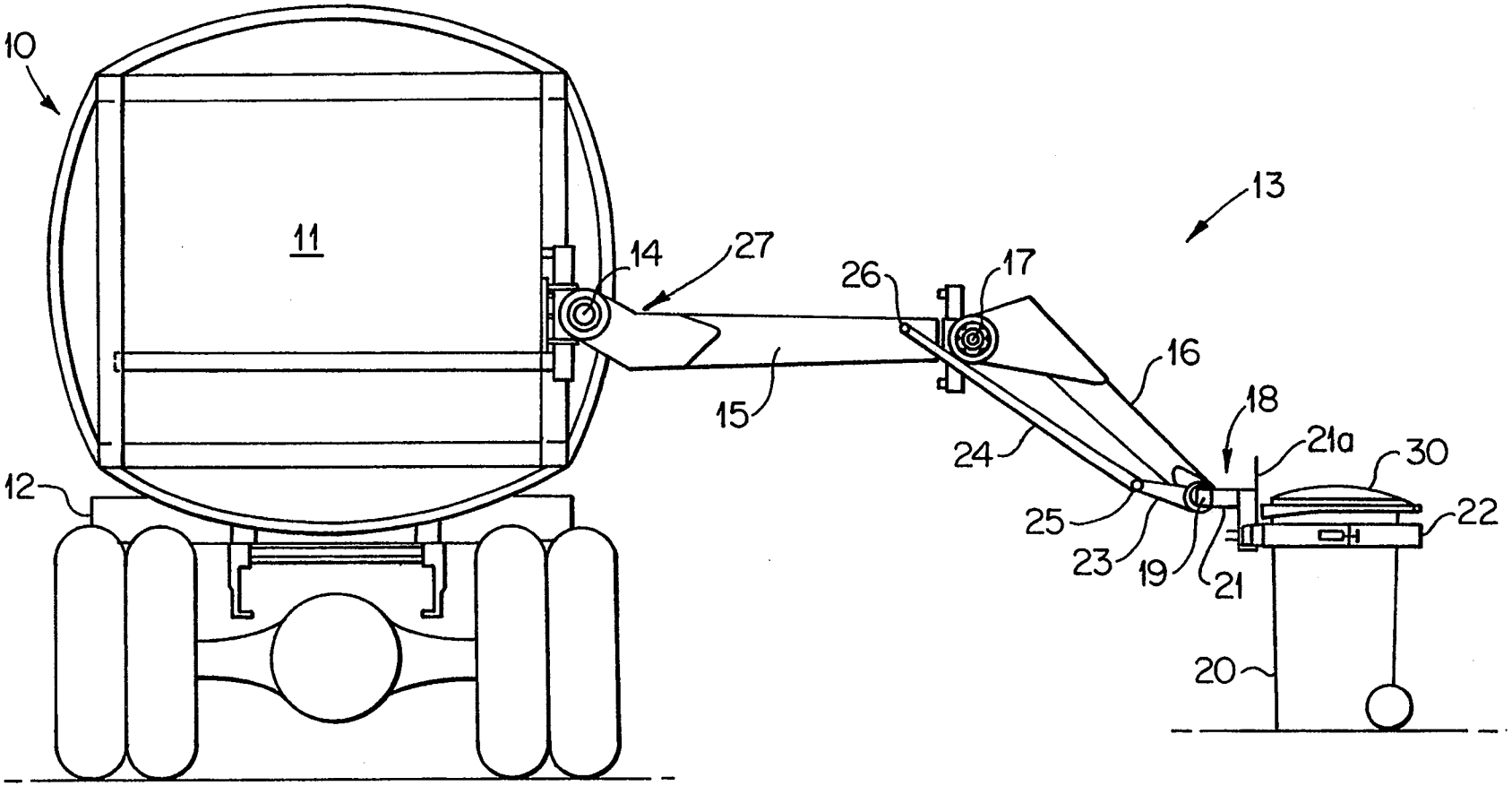
FIG. 1 shows a refuse collection vehicle with a preferred refuse loader arm assembly in a first reach position engaging a bin.

The refuse collection vehicle 10 of FIG. 1 includes a refuse storage chamber 11 mounted on a mobile chassis 12. A refuse bin 20 is shown adjacent the vehicle 10. An arm assembly 13 is supported on one side of the vehicle 10 at pivot point 14.

Figure 2:
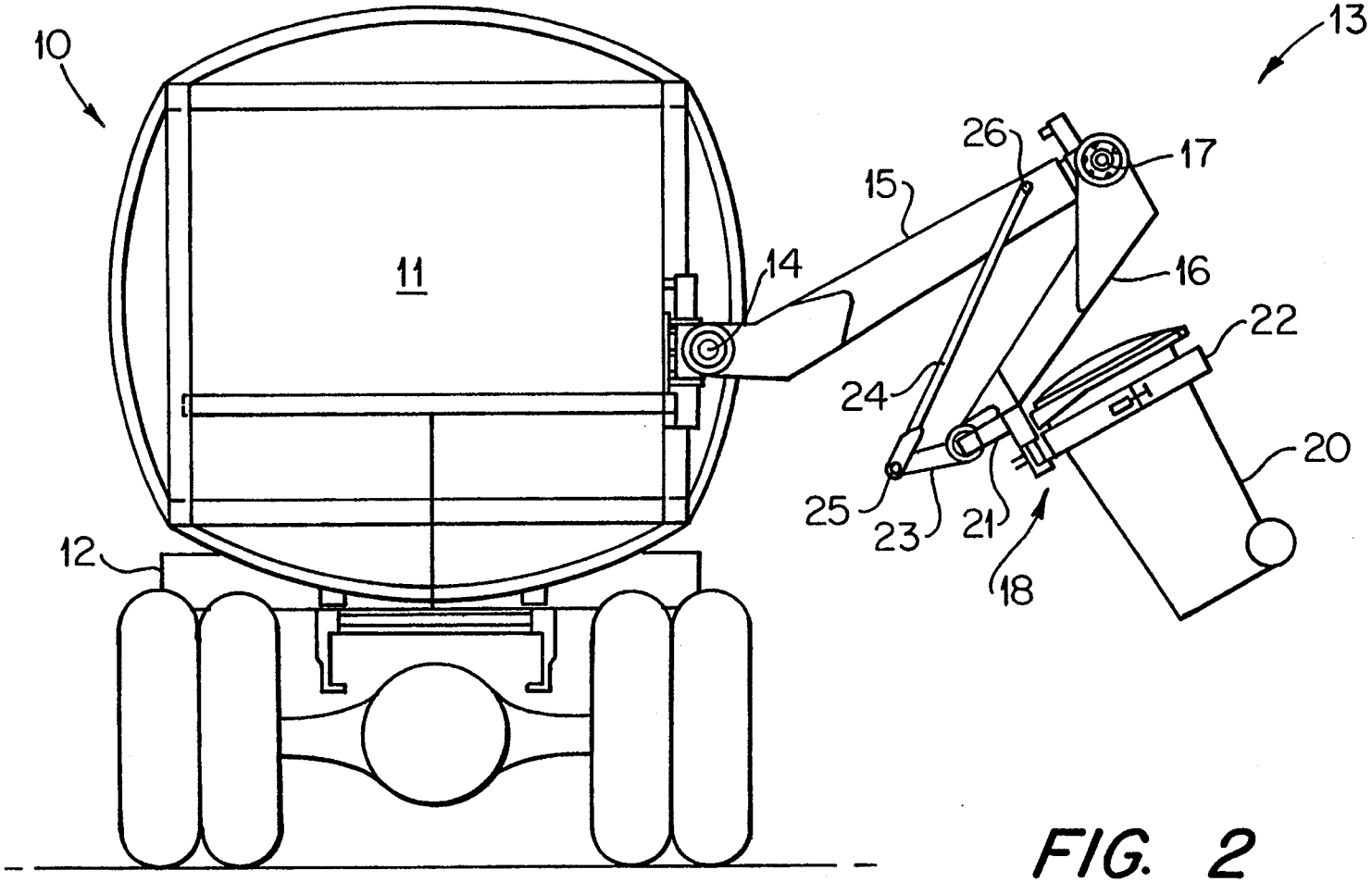
FIG. 2 shows a refund collection vehicle with the loader arm assembly and engaged bin of FIG. 1 in a second transitional lift position.
Figure 3:
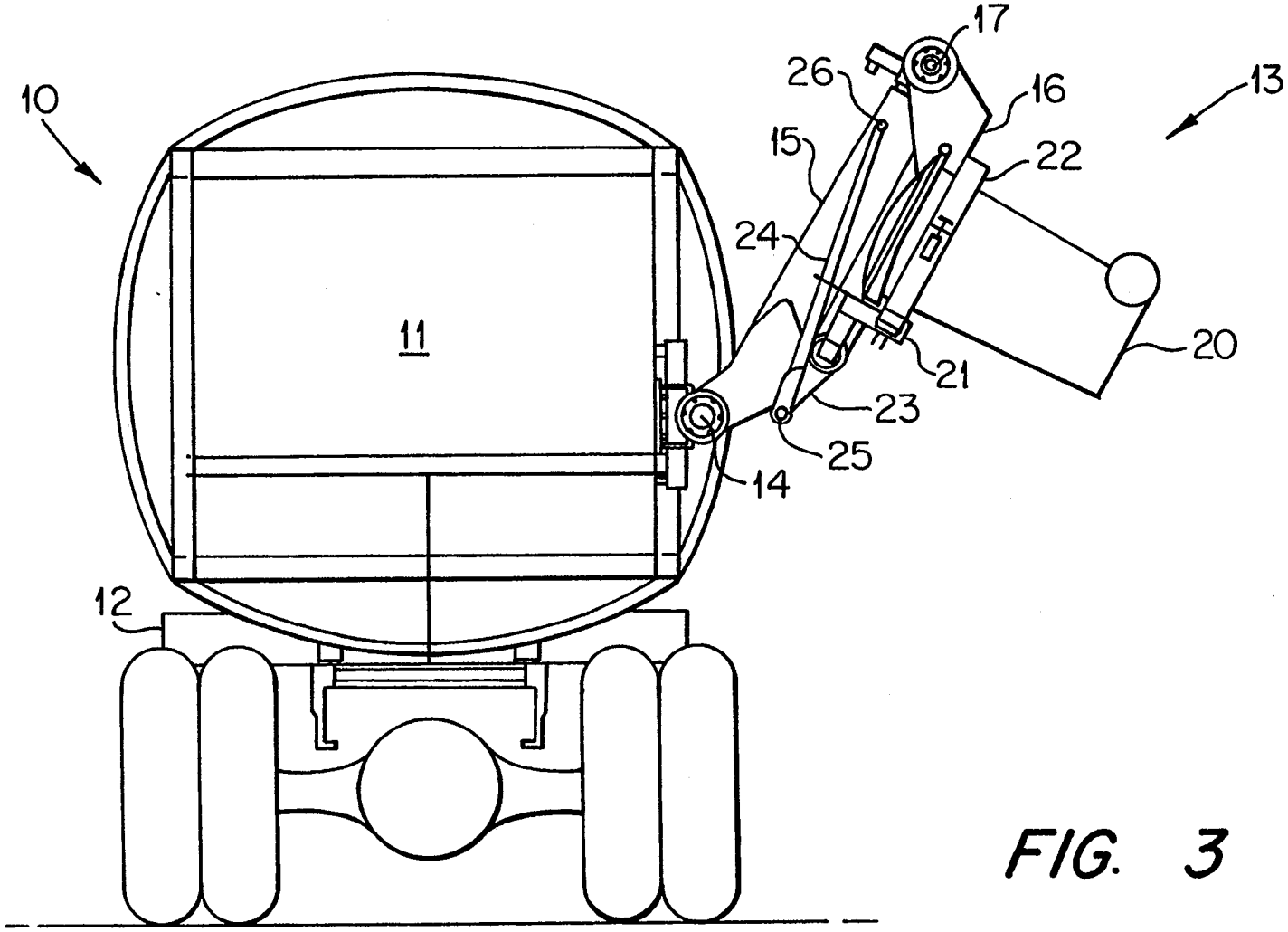
FIG. 3 shows a refuse collection vehicle with the loader arm assembly and engaged bin of FIGS. 1 and 2 in a third transitional lift position.
Figure 4:
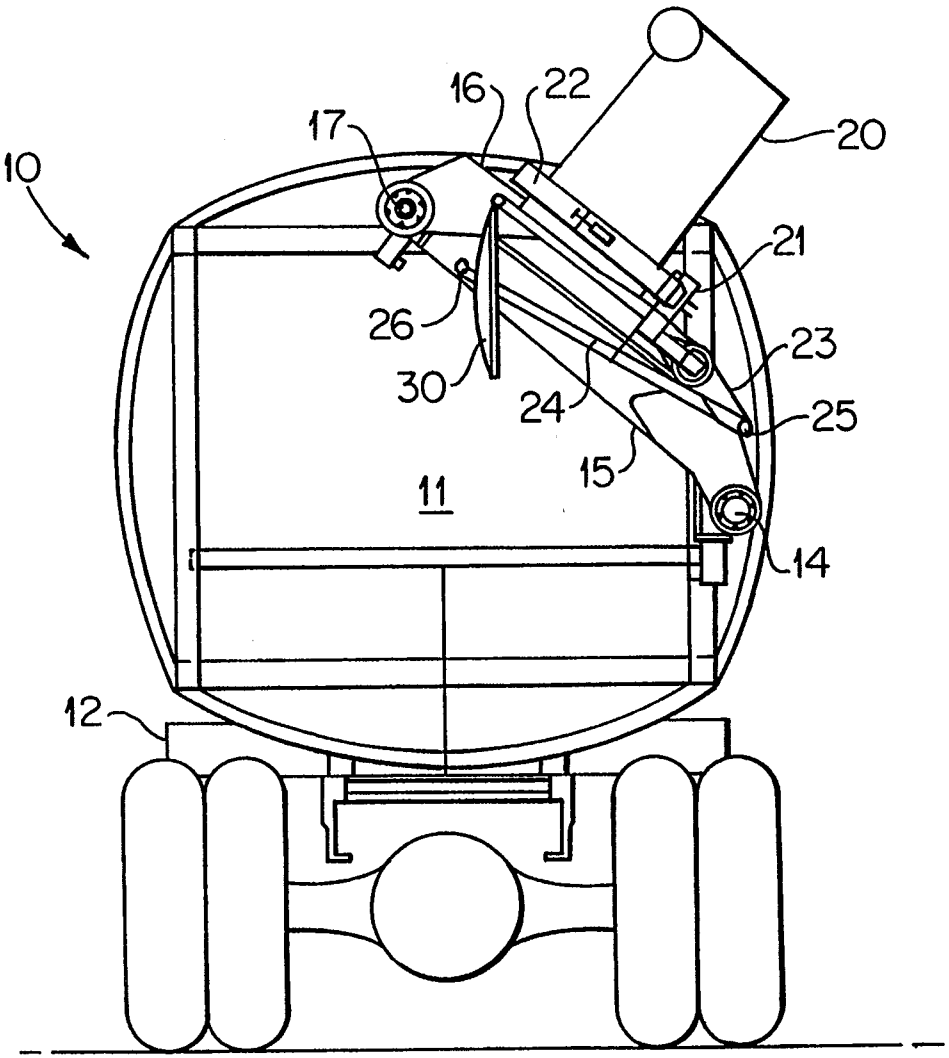
FIG. 4 shows a refuse collection vehicle with the loader arm assembly and engaged bin of FIGS. 1 to 3 in a dump position.

FIGS. 1 to 4 show four instantaneous positions that the refuse bin 20 assumes in being raised by the arm assembly 13 with a continuous movement from its rest position as shown in FIG. 1 on the ground adjacent the vehicle 10 to its dump position as shown in FIG. 4 over an entry chute (not shown) of the chamber 11.

Referring specifically to FIG. 1, the arm assembly 13 includes a lift limb 15 and reach limb 16 articulated to one another at pivot point 17. The reach limb 16 is articulated at its other end to a grab assembly 18 at pivot point 19.

The pivot points 14, 17 and 19 each have a pivotal axis parallel to the direction of travel of the vehicle 10 for limited upwards and downward movement of the limbs 15 and 16 and grab assembly 18.

The grab assembly 18 includes a wrist member 21 fixedly attached at one end to a nipper arrangement 22 and fixedly attached at its other end to a crank 23. The nipper arrangement 22 is shown side-on grabbing the refuse bin 20.

The crank 23 is articulated at its other end to a link member 24 at pivot point 25. The other end of the link member 24 is articulated to lift limb 15 at pivot point 26.

Figure 5:
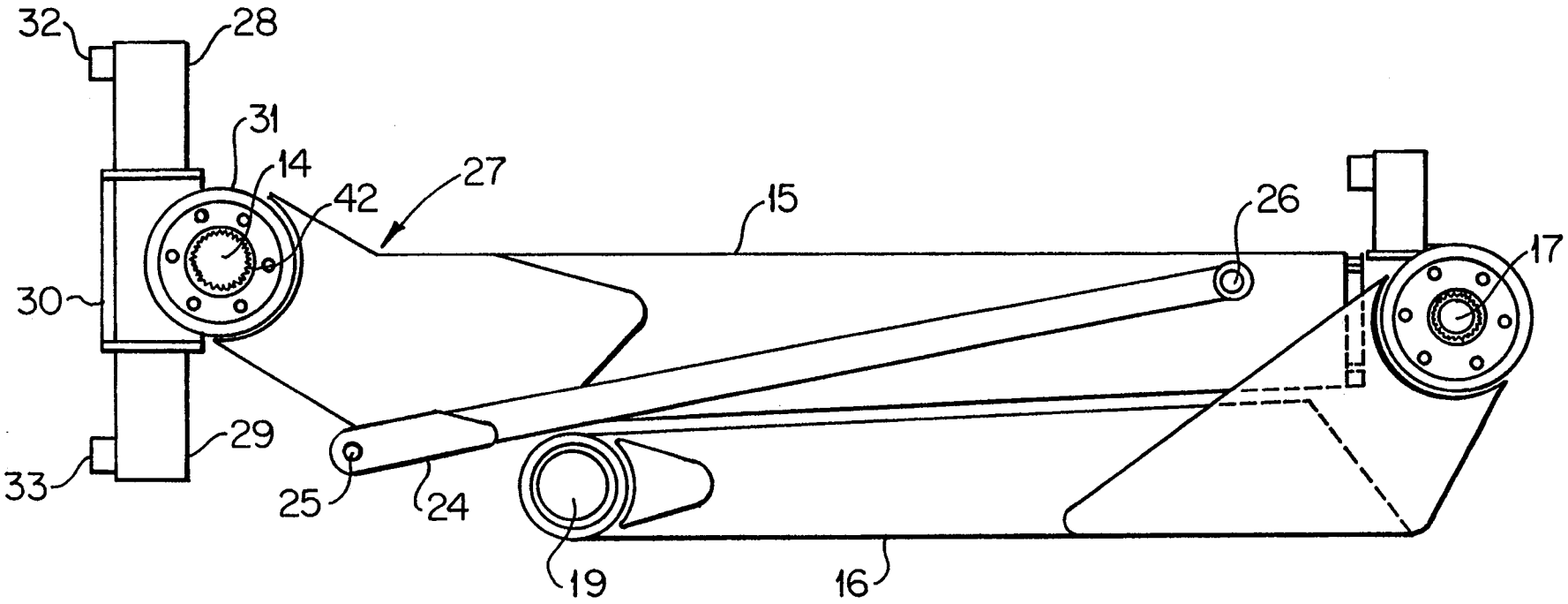
FIG. 5 shows a portion of the loader arm assembly with limb actuating means.

FIG. 5 shows the arm assembly 13 without the grab assembly 18, and so includes the lift limb 15, the reach limb 16 and the link member 24.

Referring to FIGS. 2 and 3, these intermediate positions for the arm assembly 13 and bin 20 show that in raising the bin 20 to its dump position as shown in FIG. 4, the lift limb 15 and reach limb 16 are caused to rotate in a semi-rotary fashion about their respective pivot points in opposite directions.

The lift limb 15 follows an anticlockwise arc about pivot point 14 and the reach limb 16 follows a clockwise arc about pivot point 17, so that as the lift limb 15 is being raised, the reach limb 16 is being tucked in under the lift limb 15 so as to assume a fully retracted configuration for dumping. In raising the bin 20, actuation of the lift limb 15 is conducted prior to actuation of the reach limb 16 so as to provide adequate clearance between the bin 20 and the ground to allow the bin 20 to follow the reach limb 16 and be tucked in under the lift limb 15. Actuation of all the limbs of the loader arm assembly 13 is controlled by an operator manipulating a joystick (not shown).

Relative to the position that the vehicle will be temporarily parked during the bin raising and lowering procedure, the bin 20 should ideally be placed as shown in FIG. 1. This will allow the pivotal lid 30 of the bin 20 to open only when the bin 20 has reached the dump position as shown in FIG. 4 or is so close to its dump position that its momentum of travel will ensure that its contents are emptied into the chamber 11.

As shown in FIGS. 1 to 5, the lift limb 15 has a slight crank angle 27 that ensures that when the lift limb 15 is at its furthest lifting position (as shown in FIG. 4), the bin 20 is sufficiently inverted. The wrist member 21 includes a shield **21*a* to ensure that, if the bin lid 30 opens prematurely, the bin contents are caught by the shield 21*a* and slide therefrom only after the bin 20** has been inverted.

It is an important feature of the arm assembly 13 that it enables the bin 20 to reach a position where it may dump its contents automatically upon the lift limb 15 reaching at or near its furthest lifting position. This is in contrast to the grab devices of the prior art, which are normally separately actuated to allow dumping to occur only after the bin has reached a predumping position over a storage chamber. This has conventionally been done by the operation of one or more hydraulic cylinders as mentioned earlier.

This automatic dumping feature of the loader arm assembly 13 is the result of an arm assembly linkage circuit consisting of the lift limb 15, reach limb 16, crank 23 and link member 24, that creates a sliding parallelogram of linkages whereby the lift limb 15 and the nipper arrangement 22, which is a rigid extension of the crank 23 and wrist member 21, are maintained in parallel relationship throughout the bin raising and lowering procedure.

Pivot points 19, 25 and 26 are freely pivoting so that when the lift limb 15 is being raised and the reach limb 16 is being tucked in beneath it, the link member 24 co-operates with the crank 23 to maintain the alignment of the nipper arrangement 22 with the lift limb 15.

At each of the pivot points 14 and 17, pivotal actuation is controlled by hydraulic rams which are an assembly of opposed cylinders acting to reciprocate a rack engaging on a gear. The gear is keyed or connected to its respective limb and so guides its rotary movement.

Figure 6:
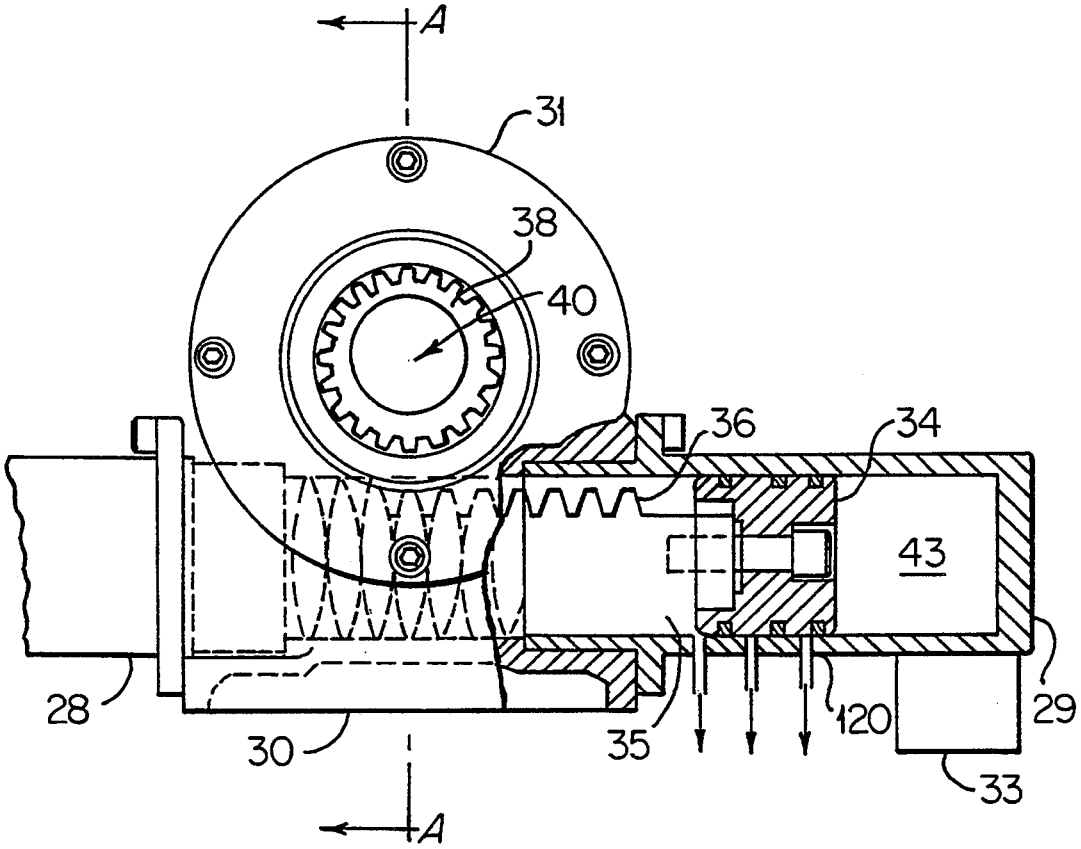
FIG. 6 shows a partly broken away view of the limb actuating means of FIG. 5.
Figure 7:
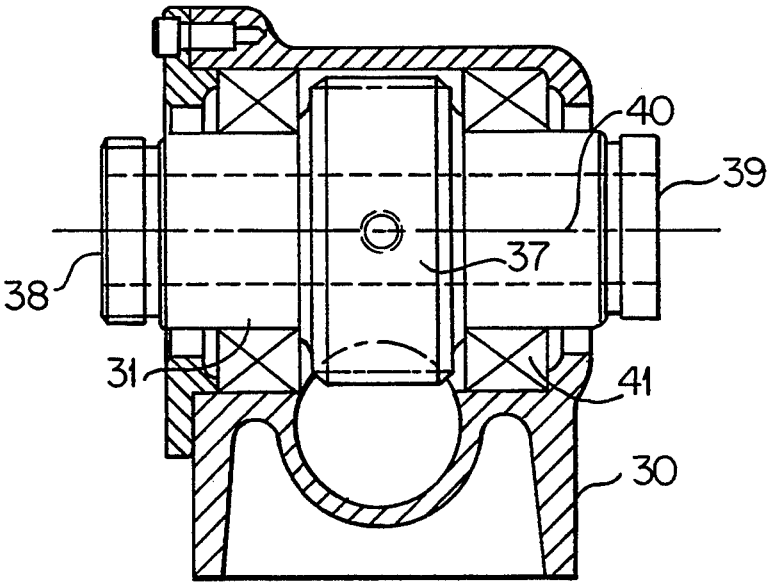
FIG. 7 shows a sectional view through A—A of the limb actuating means of FIG. 6.

These rack and gear pivotal actuation assemblies at both pivot points 14 and 17 are designed and operate identically, and are shown in more detail in FIGS. 5 to 7.

Referring firstly to FIG. 5, the pivotal actuation assembly at pivot point 14 has two cylinders 28 and 29 mounted on opposite sides of a housing 30 and gear assembly 31. The cylinders 28 and 29 have check valves 32 and 33 respectively.

Internal detail of the pivotal actuation assemblies at pivot points 14 and 17 is shown in FIGS. 6 and 7. For ease of reference, FIG. 6 only shows one of the two opposed cylinders in internal detail. The cylinder 28 has identical internal detail to the detail of cylinder 29 shown.

Located within cylinder 29 is a piston 34 and an end portion of a rack 35. The rack 35 extends across the housing 30 and into the opposed cylinder 28. The rack 35 has teeth 36 that meshingly engage with teeth (not shown) borne on an inner gear 37 of the gear assembly 31. A pair of opposed outer gears 38 and 39 are fixed to and driven by the inner gear 37. The outer gears 38 and 39 and the inner gear 37 share the same axis of rotation 40. The gear assembly 31 is mounted on bearings 41 enclosed in the housing 30. Although not shown in FIGS. 6 and 7, the outer gears 38 and 39 are connected or keyed to the limb which they guide. When hydraulic fluid enters the bore 43 of the cylinder 29, it exerts pressure against the piston 34 which, in turn, pushes the rack 35 towards the left as shown in FIG. 6. The meshing engagement between the rack teeth 36 and teeth of the inner gear 37 causes the gear 37 to rotate with the resultant rotation of the outer gears 38 and 39 and the respective connected limb.

Referring to the pivotal actuation assembly for the lift limb 15, as shown in FIG. 5, hydraulic fluid is fed into the upper cylinder 28 and this results in downward movement of the rack enclosed within the opposed cylinders 28 and 29 and housing 30. This leads to the outer gears (only outer gear 42 shown in FIG. 5) rotating in an anti-clockwise direction, thereby raising the lift limb 15 about pivot point 14.

So as to enable the reach limb 16 to tuck in under the lift limb 15, as shown in the sequence of FIGS. 1 to 4, hydraulic fluid is fed into the lower cylinder of the pivotal actuation assembly for the reach limb 16 and this results in upward movement of the rack with subsequent clockwise rotation of the outer gears and the connected reach limb 16.

Return downward movement on lowering of the limb members 15 and 16 after reaching the dump position or from their transit position when the vehicle is moving to its next pick up site is effected by reversing the operations that control the raising procedure.

The principle of semi-rotary actuation under which these pivotal actuation assemblies work ensures that the limb members travel through their arc with constant speed.

Towards the end of the arc of travel, the limb members may be decelerated automatically by a metering out of hydraulic fluid from the bore of the cylinder enclosing the resistance or low pressure driven piston. The metering out of hydraulic fluid is achieved by having a linear series of metering or throttling ports passing through the cylinder wall and located within the cylinder bore at a position corresponding to near the end of the resistance piston stroke and which communicate with a low or non-pressurized reservior. The metering ports are sized so that the resistance piston, in being pushed by the rack, progressively cover larger to smaller ports. Under pressure of hydraulic fluid, the drive piston pushes the rack and, as the resistance or driven piston nears the end of its stroke and the limb nears the limit of its arc of travel, the first of the drain ports will be covered when the resistance piston passes over it, and so lead to restricted exit of hydraulic fluid only through the remaining exposed ports. Less hydraulic fluid will then escape from the bore to the outside, resulting in an increase of hydraulic pressure on the resistance piston and a slight deceleration of the limb movement. As the resistance piston passes over and leads to the covering of more and progressively smaller drain ports, more fluid is lost but at a lower rate and back pressure is built up leading to further deceleration. Termination of the stroke of both the drive and resistance pistons therefore will not be met with a sudden shudder, but rather the limb will come to a more gradual halt. A series of metering ports 120 is shown in FIG. 6.

Figure 8:
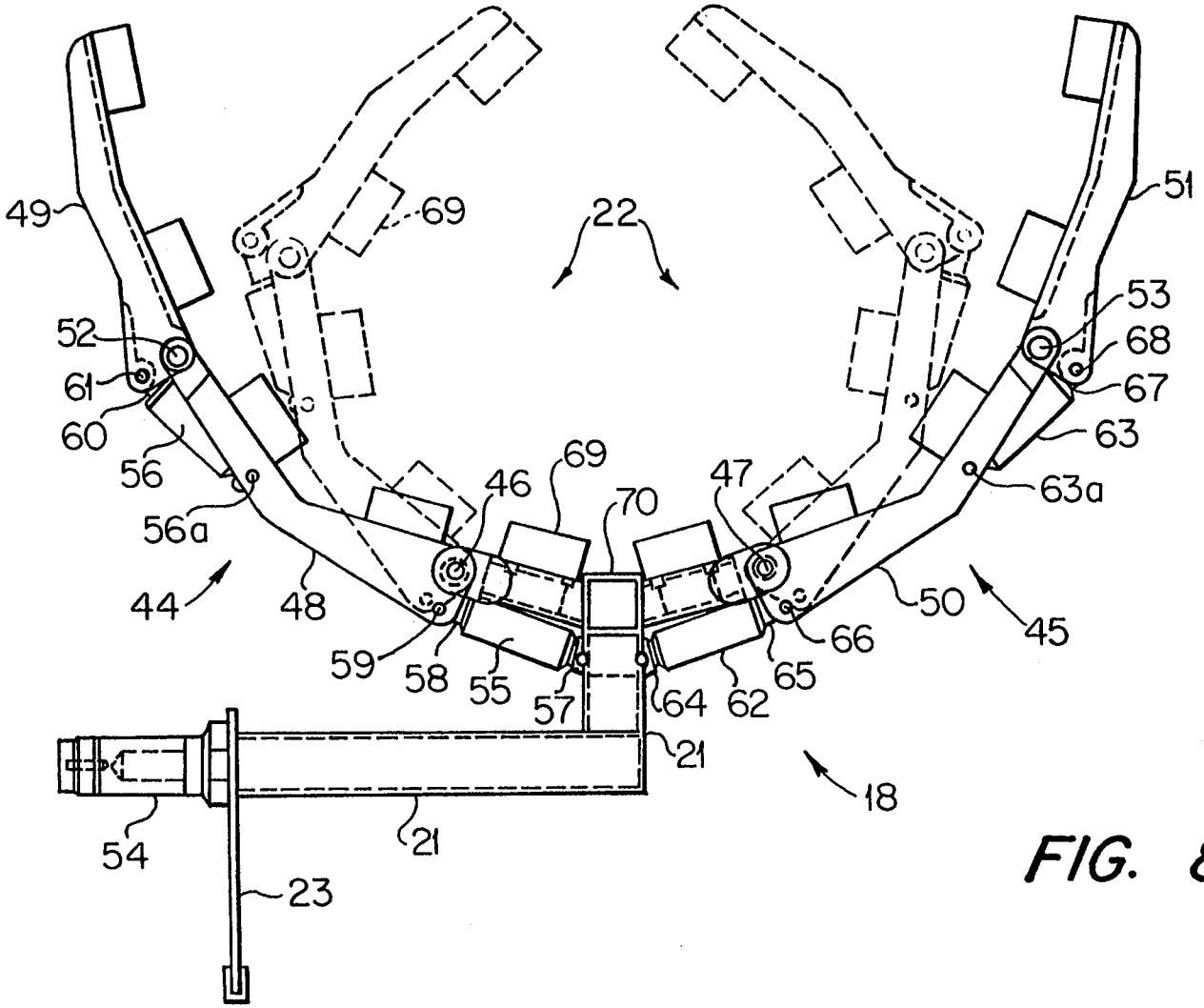
FIG. 8 shows the grab assembly of the loader arm assembly of FIGS. 1 to 4, FIGS. 9 and 10 show two orientations of bin being grabbed by the nipper arrangement of the grab assembly of FIG. 8, and FIG. 11 schematically shows a hydraulic circuit diagram and interacting valve systems that control the operation of the loader arm assembly of FIGS. 1 to 4 including the grab assembly of FIG. 8.

The grab assembly 18 shown in FIG. 8 includes a wrist member 21, a nipper arrangement 22 and a crank 23. The nipper arrangement 22 is shown in both an expanded configuration and a contracted configuration for ease of reference. The wrist member 21 has a shaft 54 adapted to seat a bearing (not shown) of the reach limb 16 and so allow pivotal movement of the grab assembly 18 about pivot point 19. The other end of the wrist member 21 conprides a T-piece 70.

The nipper arrangement 22 has a pair of finger members 44 and 45 each of which are articulated to the T-piece 70 of the wrist member 21 at pivot points 46 and 47 respectively.

Finger member 44 has an inner limb 48 and an outer limb 49. Finger member 45 has an inner limb 50 and an outer limb 51. For finger member 44, the inner limb 48 is articulated to the outer limb 49 at pivot point 52. For finger member 45, the inner limb 50 is articulated to the outer limb 51 at pivot point 53. The pivot points 46, 47, 52 and 53 each have a vertical pivotal axis.

The pivotal motion of finger member 44 is controlled by a pair of hydraulic cylinders 55 and 56. Cylinder 55 is pivotally connected to a mount 57 on wrist member 21. The rod 58 of cylinder 55 is fixedly connected to a point 59 on inner limb 48 remote of pivot point 46 so that extension of the rod 58 will cause the opposite end of the inner limb 48 to move in an arc and contract as shown towards the centre of the nipper arrangement 22.

Cylinder 56 is pivotally connected to inner limb 48 at point **56*a* and has its rod 60 fixedly connected to a point 61 on the outer limb 49 remote of the pivot point 52 so that extension of the rod 60 will cause the opposite end of the outer limb 49 to move in an arc and contract as shown towards the centre of the nipper arrangement 22**.

The pivotal motion of finger member 45 is controlled by a pair of hydraulic cylinders 62 and 63. Cylinder 62 is pivotally connected to a mount 64 on wrist member 21. The rod 65 of cylinder 62 is fixedly connected to a point 66 on inner limb 50 remote of pivot point 47 so that extension of the rod 65 will cause the opposite end of the inner limb 50 to move in an arc and contract as shown towards the centre of the nipper arrangement 22.

Cylinder 63 is pivotally connected to inner limb 50 at point 63a and has its rod 67 fixedly connected to a point 68 on the outer limb 51 remote of the pivot point 53 so that extension of the rod 67 will cause the opposite end of the outer limb 51 to move in an arc and contract as shown towards the centre of the nipper arrangement 22.

The nipper arrangement 22 and T-piece 70 have grip padding 69 as shown to assist in the grabbing of and grip on the bin 20.

By sequential actuation of the cylinders controlling the inner limbs and outer limbs of the nipper arrangement 22, the nipper arrangement 22 can be made to close in around and grab the bin. Normally, this will be done by actuation of the inner limbs first and with equal displacement, so that the inner limbs may close in, followed by equal displacement actuation of the outer limbs, so that the outer limbs may close in. However, situations may arise where a bin is not square with the vehicle 10 and so the sequence of cylinder actuation of the nipper arrangement 22 will need to be adapted to grab and raise stably such a bin. This is achieved in the present embodiment by having the hydraulic fluid that feeds all the cylinders of the nipper arrangement follow a circuit that allows the fluid to follow a path of least resistance in response to any unequal back pressures sensed on each of the cylinders. This will be described in more detail with reference to FIG. 11.

Figure 9:
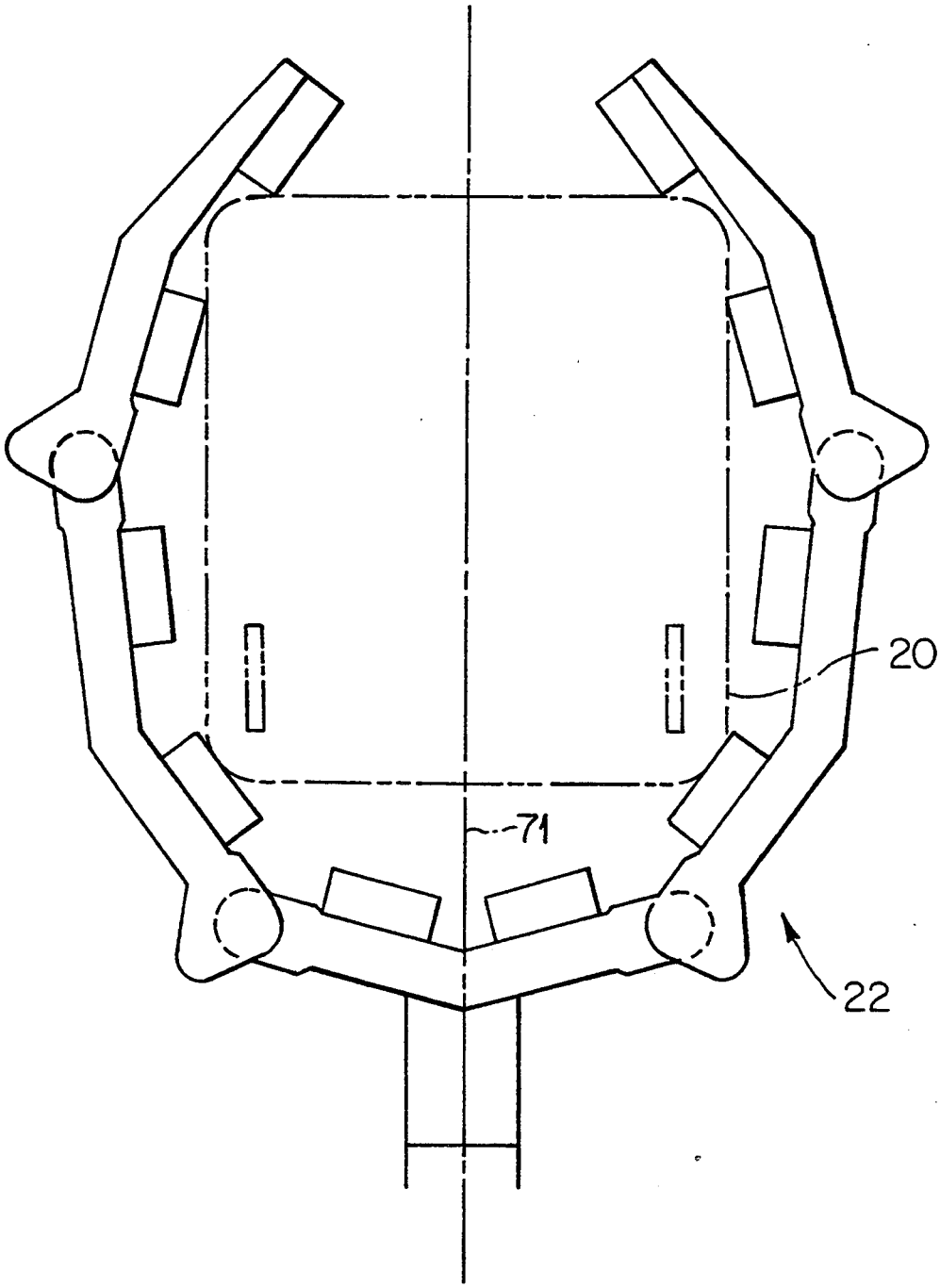

FIG. 9 shows the nipper arrangement 22 (cylinders not shown for ease of reference) grabbing bin 20 that is square with the axis 71 of the nipper arrangement.

Figure 10:
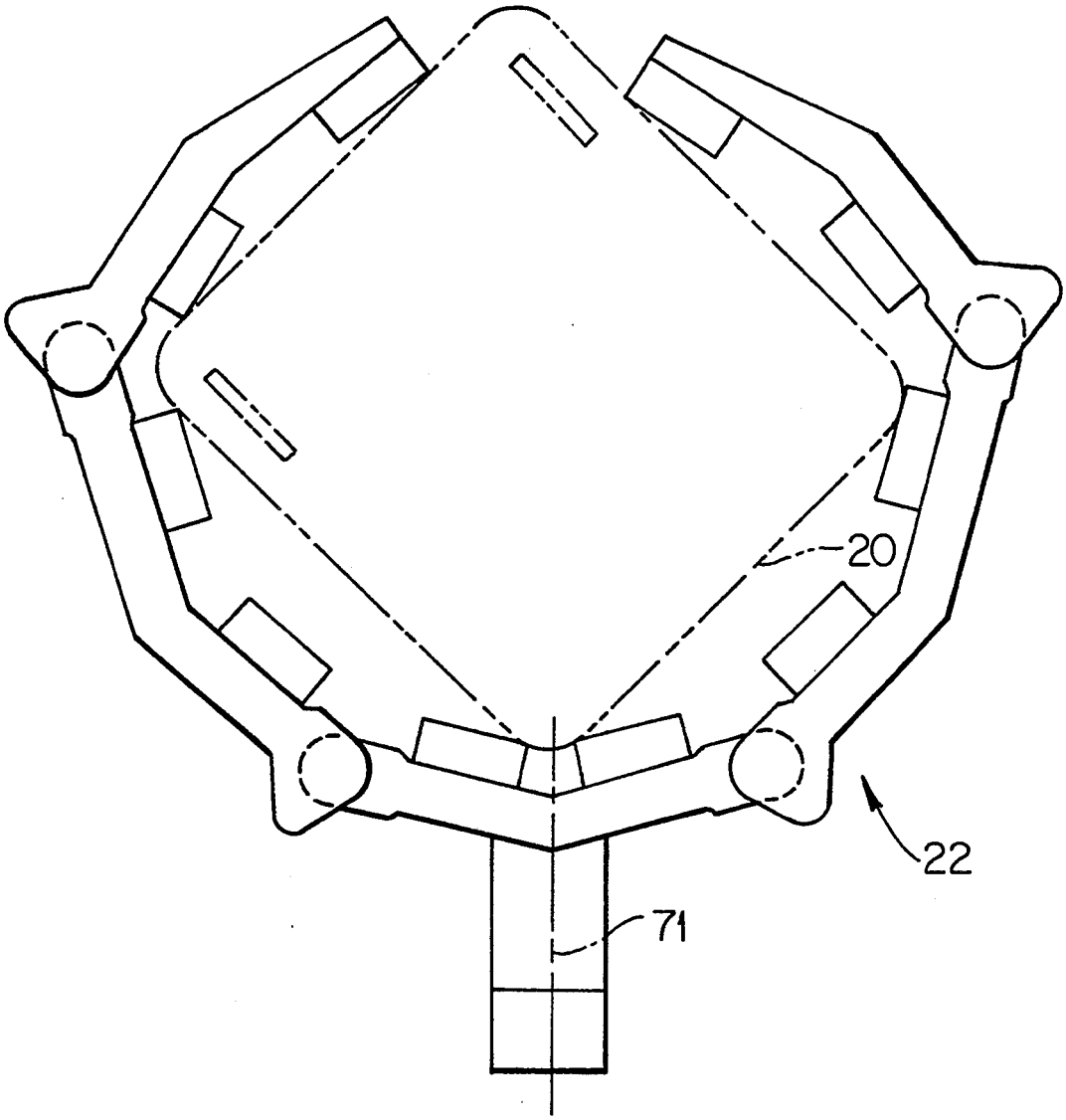

FIG. 10 shows the same nipper arrangment 22 grabbing bin 20 that is not square with the axis 71 of the nipper arrangement 22.

Figure 11:
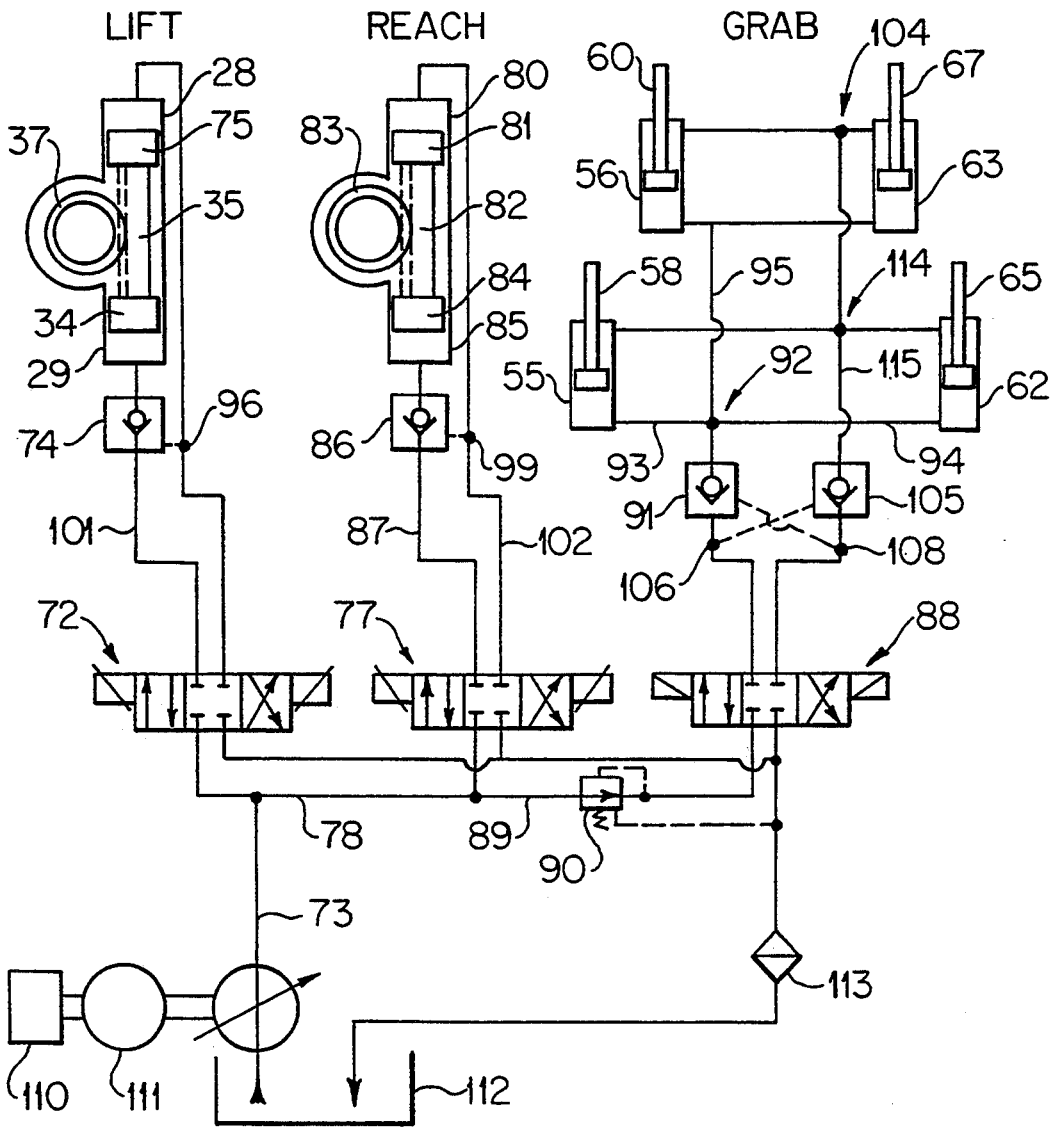

FIG. 11 is a schematic diagram of the hydraulic circuit and interacting valve systems that operate the lift limb 15, reach limb 16 and nipper arrangement 22 of the arm assembly 13. The valve orientation shown represents the transit or stationary position of the arm assembly 13, such as when the arm assembly is in the positions shown in FIGS. 1 and 4.

In order to move the arm assembly 13 from its ideal transit position (corresponding to the dump position of FIG. 4) to its bin pick up position shown in FIG. 1, the operator manipulates a joystick (not shown) to cause the lift limb 15 to be lowered and the reach limb 16 to extend or be swung outwardly. In carrying out this operation, the lift limb proportional valve 72 is energized causing the valve to assume a position corresponding to the parallel opposed arrow orientation as shown. In this orientation, the engine (110) powered pump 111 pumps hydraulic fluid from a tank 112 through delivery line 73, past valve 72 and a pilot operated check valve 74 into the end of the cylinder 29. The pressure of the hydraulic fluid causes piston 34 to push the rack 35 upwardly as shown in FIG. 11, and its meshing engagement with the teeth of the inner gear 37 causes the lift limb connected outer gears 38 and 39 (shown in FIG. 6) to rotate in an anti-clockwise direction with reference to FIG. 11, thereby lowering the lift limb 15.

The rack 35 also moves against piston 75 and forces hydraulic fluid to escape from the end of the opposed cylinder 28, through return line 76 and, via valve 72 and filter 113, back to tank 112.

Depending on how the operator manipulates the joystick control, the lowering of the lift limb 15 may be done prior to or concurrently with the extension of the reach limb 16.

It has been found desirable to carry out the lift and reach functions concurrently. For reach limb 16 to be extended, reach limb proportional valve 77 is energized causing the valve to assume a position corresponding to the criss-crossed arrow orientation. The valve 77 is normally energized shortly after energization of valve 72, and allows hydraulic fluid to pass through line 78, pass valve 77 into the end of the cylinder 80 via line 102. The pressure of the hydraulic fluid causes piston 81 to push the rack 82 downwardly and its meshing engagement with the teeth of the inner gear 83 causes the reach limb connected outer gears (equivalent to gears 38 and 39 for lift limb 15 of FIG. 7) to rotate in a clockwise direction with reference to FIG. 8, thereby extending the reach limb 16 outwardly.

The rack 82 also moves against piston 84 and forces hydraulic fluid to escape from the end of the opposed cylinder 85, past pilot operated check valve 86, (that has been opened as a result of the pilot 99 sensing a threshold pressure in the line 102) through return line 87 and, via valve 77 and filter 113, back to tank 112.

When the lift and reach arms 15 and 16 are in their extended positions, and a bin is to be grabbed, the nipper arrangement 22 should be so placed that it surrounds the bin. Contraction or closing in of the nipper arrangement 22 around the bin can then occur under joystick control.

In carrying out the contraction operation, the nipper on-off valve 88 is energized causing the valve to assume a position corresponding to the parallel opposed arrow orientation. In this orientation, hydraulic fluid is pumped from tank 112 through delivery line 89, past a pressure regulating valve 90, valve 88 and pilot operated check valve 91 to a 3-way junction 92. The hydraulic fluid passing into lines 93 and 94 feeds into the piston ends of the cylinders 55 and 62 of the nipper inner limbs 48 and 50 respectively (shown in FIG. 8), thereby causing the respective rods 58 and 65 to extend and, as described with reference to FIG. 8, lead to the inner limbs contracting or closing in around the bin.

Hydraulic fluid passing into line 95 feeds into the piston ends of the cylinders 56 and 63 of the nipper outer limbs 49 and 51 respectively (shown in FIG. 8), thereby causing the respective rods 60 and 67 to extend and, as described with reference to FIG. 8, lead to the outer limbs contracting or closing close in around the bin.

Hydraulic fluid leaving the rod ends of the nipper cylinders will pass to a four-way junction 114 where it will meet and pass through line 115, pass an opened check valve 105 (opened as a result of fluid pressure sensed at pilot 106) and, via valve 88 and filter 113, return to tank 112.

The pressure regulating valve 90 on line 89 can regulate the flow of hydraulic fluid to the nipper cylinders and so can limit to a predetermined value the maximum pressure that the nipper arrangement 22 may exert on the bin.

The path followed by the hydraulic fluid to the inner limb cylinders 55 and 62 is shorter than that for the outer limb cylinders 56 and 63 and so, normally, the inner limbs 48 and 50 will close in earlier than the outer limbs 49 and 51. However, when a bin to be grabbed is in a skewed position or is not properly square with respect to the vehicle 10 (as shown in FIGS. 9 and 10), or where one or more of the nipper limbs meets a pressure that is greater than that experienced by the others, the circuitry shown in FIG. 11 allows the hydraulic fluid flowing from junction 92 to follow a path of least resistance to those cylinders where back pressure is lowest. In such an instance, the rods will extend only so far as to stably grab and grip the bin. This inbuilt correction facility of the nipper arrangement 22 also enables the loader arm 13 to raise bins of variable size and shape.

The nipper arrangement 22 also has the advantage of being a double joint type linkage where all four limbs may work independently on the same circuit.

When the bin has been grabbed, the joystick is operated to raise the lift limb 15 and retract the reach limb 16 (as shown in FIGS. 2 and 3) so that the arm assembly 13 and the bin 20 may assume the dump position shown in FIG. 4.

In carrying out this bin raising operation, the lift limb proportional valve 72 is energized but the valve reversed so that it assumes the crisscrossed arrow orientation as shown. In this orientation, hydraulic fluid is pumped from tank 112 through delivery line 73, and line 76 into the end of the cylinder 28. The pressure of the hydraulic fluid causes piston 75 to push the rack 35 downwardly as shown in FIG. 11, and its meshing engagement with the teeth of the inner gear 37 causes the lift limb connected outer gears 38 and 39 (shown in FIG. 6) to rotate in a clockwise direction with reference to FIG. 11, thereby raising the lift limb 15.

The rack 35 also moves against piston 34 and forces hydraulic fluid to escape from the end of the opposed cylinder 29, past pilot operated check valve 74 (that has been opened as a result of the pilot 96 sensing a threshold pressure in line 76) through return line 101 and, via valve 72 and filter 113, back to tank 112.

In order to retract or tuck in the reach limb 16, the reach limb proportional valve 77 is energized but the valve reversed so that it assumes the parallel opposed arrow orientation as shown. In this orientation, hydraulic fluid is pumped from tank 112 through delivery line 78, past valve 77 into line 87 and past check valve 86 into the end of the cylinder 85. The pressure of the hydraulic fluid causes piston 84 to push the rack 82 upwardly and its meshing engagement with the teeth of the inner gear 83 causes the reach limb connected outer gears to rotate in an anti-clockwise direction with reference to FIG. 11, thereby retracting the reach limb 16 inwardly.

The rack 82 also moves against piston 81 and forces hydraulic fluid to escape from the end of the opposed cylinder 80 through return line 102 and, via valve 77 and filter 113, back to tank 112.

Once the bin has dumped its contents, the bin is returned to its original position by reversing the operation of the proportional valves 72 and 77 for the lift and reach limbs 15 and 16 respectively.

In order to release the bin, the nipper on-off valve 88 is energized but the valve reversed so that it assumes the crisscrossed arrow orientation as shown. In this orientation, hydraulic fluid is pumped from tank through delivery line 89, past valves 90 and 88 and then past pilot operated check valve 105 and the flow of hydraulic fluid is divided at junction 114 and junction 104 so as to feed into the rod ends of all the nipper cylinders, thereby causing the respective rods to retract and, as described with reference to FIG. 8, lead to the nipper limbs expanding around and releasing the bin. Hydraulic fluid leaving the piston ends of the nipper cylinders will meet at junction 92 and pass the opened check valve 91 (opened as a result of a predetermined hydraulic fluid pressure sensed at pilot 108) and, via valve 88 and filter 113, return to tank 112.

The hydraulic control circuitry of the arm assembly 13 has a load sensing capability by inclusion of the joystick controlled proportional valves 72 and 77 and pilot operated (pressure sensitive reversible) check valves 74, 86, 91 and 105, and by having a pressure regulating valve 90 and a nipper limb pressure correction facility on the circuit connecting the nipper cylinders.

Once the empty bin has been released, the loader arm assembly 13 may be raised and returned to its transit position.

Various modifications may be made in details of design and construction without departing from the scope or ambit of the invention. For instance, with reference to the lift limb and reach limb pivotal actuation assemblies, instead of the gear being fixed to the respective limb and being caused to rotate by engagement with an opposed cylinder rack, as described above, a modification of the above embodiment may have the gear fixed (non-rotatable) and the opposed cylinder rack fixed to the respective limb so that, with movement of the rack by one of the opposed cylinders, the rack will be forced to rotate by following a tangential path about the gear, and so cause the rack connected limb to also turn around the fixed gear.

I claim:

1. A refuse loader arm assembly for reaching and grabbing a refuse bin from a rest position on the ground laterally spaced from a refuse storage chamber fitted with said refuse loader arm assembly, and for raising said bin to a dump position in which refuse in said bin falls by action of gravity into said refuse storage chamber, said arm assembly comprising:

a first limb having at one end thereof a pivotal connection at a first pivot point and being pivotally connected at an opposite end thereof to one end of a second arm assembly, said second arm assembly including, at an opposite end from said one end thereof, a grab assembly for grabbing said bin; and a linkage means, coupled between said first limb and said grab assembly, for providing that said grab assembly is maintained at a fixed angular orientation with respect to said first limb independently of the angular orientation of said second arm assembly with respect to said first limb throughout raising of said bin, and providing that by pivoting said first limb said bin is disposed in said dump position so that said refuse in said bin is automatically dumped into said refuse storage container.

2. The refuse loader arm assembly of claim 1, wherein the linkage means comprises a linkage limb pivotally connected at one end to the first limb and at an opposite end to a crank arm of said grab assembly.

3. The refuse loader arm assembly of claim 2, wherein said second arm assembly comprises a second limb pivotally connected to the first limb at a second pivot point, said grab assembly being pivotally connected to the second limb at a third pivot point and to said linkage limb at a fourth pivot point located on said crank arm, and said linkage limb being pivotally connected to the first limb at a fifth pivot point, whereby said second, third, fourth, and fifth pivot points interconnect said first limb, second limb, grab assembly and linkage limb into a parallelogram structure.

4. The refuse loader arm assembly of claim 3, wherein said grab assembly includes first and second symmetrically opposed grab fingers.

5. The refuse loader arm assembly of claim 4, wherein each of said first and second grab fingers comprise first and second limbs articulated about a common pivot point.

6. The refuse loader arm assembly of claim 5, wherein both said first and second symmetrically opposed grab fingers are pivotally connected to a common portion of said grab assembly about separate pivot points.

7. The refuse loader arm assembly of claim 6, further comprising a plurality of hydraulic cylinders for centrally pivoting about respective pivot points of said first and second grab fingers.

8. The refuse loader arm assembly of claim 7, wherein all of said plurality of hydraulic cylinders are fed from a common hydraulic fluid supply so that equal fluid supply pressure is experienced by each of said cylinders whereby a substantially equal force is exerted by each said cylinder.

9. The refuse loader arm assembly of claim 1, wherein a first hydraulic ram controls pivoting of said first limb about said first pivot point relative to said refuse storage chamber.

10. The refuse loader arm assembly of claim 9, wherein a second hydraulic ram controls pivoting of said first limb with respect to said second arm assembly.

11. The refuse loader arm assembly of claim 10, further comprising a controller including a joy stick for controlling the operation of said first hydraulic ram and of said second hydraulic ram such that movement of the joy stick through a first line of movement controls the said first hydraulic ram only and movement of said joy stick through a second and different line of movement controls the second hydraulic ram only and movement of said joy stick through an intermediate line causes concurrent actuation of said first and second hydraulic rams.

12. A refuse loader arm assembly of claim 11, wherein said first line of movement is perpendicular to said second line of movement and so concurrent actuation of both hydraulic rams may be initiated by moving the joy stick in a diagonal line from a start of said first line to an end of said second line.

13. A refuse loader arm assembly of claim 12, wherein said refuse storage chamber is mounted on a vehicle.

14. A refuse loader arm apparatus, mountable on a refuse storage chamber carried by a vehicle, for reaching and grabbing a refuse bin from a rest position on the ground laterally spaced from a refuse storage chamber on which said refuse loader arm apparatus is mounted, and for raising said bin to a dump position in which refuse in said bin falls, by action of gravity, into said refuse storage chamber, said refuse loader arm apparatus comprising:

an arm assembly;

a first limb for pivotal connection at one end thereof to a vehicle carrying said bulk refuse container at a first pivot point and pivotally connected at an opposite end to one end of said arm assembly, said arm assembly including, at an opposite end from said one end thereof, a grab assembly for grabbing a bin; and, a linkage means, coupled between said first limb and said grab assembly, for providing, in cooperation with said first limb and said grab assembly, that said grab assembly is maintained as a fixed angular orientation with respect to said first limb independently of the angular orientation of said arm assembly with respect to said first limb throughout raising of a bin, and that by pivoting said first limb, a bin that has been grabbed by said grab assembly is disposed in said dump position so that refuse in that bin is automatically dumped into said refuse storage chamber.

15. The refuse loader arm apparatus of claim 14, wherein said grab assembly includes a crank arm wherein the linkage means comprises a linkage limb pivotally connected at one end to the first limb and at an opposite end to said crank arm of said grab assembly.

16. The refuse loader arm apparatus of claim 15, wherein said arm assembly comprises a second limb pivotally connected to the first limb at a second pivot point, said grab assembly being pivotally connected to the second limb at a third pivot point and to said linkage limb at a fourth pivot point located on said crank arm, and said linkage limb being pivotally connected to the first limb at a fifth pivot point, whereby said second, third, fourth, and fifth pivot points interconnect said first limb, said second limb, said crank arm and said linkage limb to form a parallelogram.

* * * * *